US005490406A

United States Patent [19]

College

[11] Patent Number: 5,490,406

[45] Date of Patent: Feb. 13, 1996

[54] CRIMPING TOOL HAVING DIE BOTTOMING MONITOR

[75] Inventor: David A. College, Annville, Pa.

[73] Assignee: The Whitaker Corporation, Wilmington, Del.

[21] Appl. No.: 292,905

[22] Filed: Aug. 19, 1994

[51] Int. Cl.[6] ..... H01R 43/048

[52] U.S. Cl. ..... 72/30.1; 72/31.01; 72/37; 72/412; 29/715; 29/720; 29/753

[58] Field of Search ..... 72/35, 36, 31, 72/30, 21, 410, 412, 26, 37; 29/753, 751, 720, 715

[56] References Cited

U.S. PATENT DOCUMENTS

| | | | |
|---|---|---|---|
| 2,882,766 | 4/1959 | Towler | 72/21 |
| 3,808,859 | 5/1974 | Cameron | 72/31 |
| 4,294,006 | 10/1981 | Bair | 29/753 |
| 4,406,061 | 9/1983 | Moriyama | 29/751 |
| 4,856,186 | 8/1989 | Yeomans | 29/863 |
| 4,936,126 | 6/1990 | Sato | 72/30 |
| 5,101,651 | 4/1992 | Yeomans | 72/19 |
| 5,168,736 | 12/1992 | Enneper | 72/26 |
| 5,299,463 | 4/1994 | Gross | 29/753 |

FOREIGN PATENT DOCUMENTS

| | | | |
|---|---|---|---|
| 2737015 | 3/1979 | Germany | 72/30 |

*Primary Examiner*—Daniel C. Crane
*Attorney, Agent, or Firm*—Robert J. Kapalka

[57] ABSTRACT

A crimping apparatus includes a pair of relatively movable jaws (22) carrying a mating pair of crimping dies (25). Stop surfaces (30) on respective ones of the jaws are in abutting relationship when the dies are fully closed. A flat film sensor (40) on one of the stop surfaces is coupled in an electrical circuit so as to produce an electrical signal when the stop surfaces come together and a force is imposed on the sensor. The electrical signal may be used to illuminate a visual display, generate an audio tone, or trigger an actuator which causes the jaws to retract to an open position.

17 Claims, 4 Drawing Sheets

CRIMPING TOOL HAVING DIE BOTTOMING MONITOR

FIELD OF THE INVENTION

The invention relates to a tool having relatively movable jaws which bottom against each other when the jaws are fully closed during tool operation, and a monitor to verify that the jaws have bottomed.

BACKGROUND OF THE INVENTION

Crimping is a well-known method of attaching a terminal to a conductor. For a strong and electrically efficient crimped connection, the terminal must be deformed sufficiently to provide solid metal-to-metal contact with the conductor, but the terminal and conductor must not be overstressed to the point where the metal is weakened and fractured. A common non-destructive method of determining the quality of a crimped connection is by measuring the crimp height, i.e., the vertical dimension of the terminal after crimping. The measured crimp height is compared with a target crimp height which has previously been determined, by one or more of various possible mechanical and electrical tests, to be desirable for the particular style, size, and material of the terminal and conductor which are being used. Terminals having a crimp height which is outside of the tolerance range for the target crimp height are rejected as defective.

The crimp height of many terminals cannot be readily measured. This may be due to an unusual crimp configuration having a surface profile which cannot be accurately engaged by a measuring probe, and/or the presence of insulation on the terminal which may pull away from the surface of the terminal and generate a false reading. Historically, this problem was addressed by the use of bottoming dies having opposed stop, or bottoming, surfaces which are arranged to engage, or bottom, against each other when the dies are fully closed. The bottoming dies are configured so that when the dies are driven together and the stop surfaces have bottomed, a terminal engaged between the dies will have been deformed to the correct crimp height. Bottoming of the stop surfaces provides an indication that the terminal has been fully crimped and prevents excessive deformation of the terminal. Therefore, the inability to accurately measure the crimp height becomes immaterial.

A problem with the use of bottoming dies is that defects in crimping tools or processes may prevent the dies from bottoming. Such defects include deflection of drive components or tool frames, loose or worn parts, improper set-up, and dirt, among others. It is impossible to determine visually whether die closure has occurred in every case. In some cases the stop surfaces may come quite close together without actually bottoming, and even these cases may result in defective crimps when the crimp height tolerance is only a few thousandths of an inch. There is a need for a crimping apparatus of the type having bottoming dies which has a means for verifying whether the dies have fully closed in every case.

SUMMARY OF THE INVENTION

It is an object of the invention to promote quality in crimped connections.

It is another object of the invention to ensure that crimped connections have the correct crimp height.

It is a further object of the invention to verify the crimp height of a terminal by indirect measurement.

It is yet another object of the invention to increase the effectiveness of crimping tools having bottoming dies.

These and other objects are accomplished by a crimping apparatus comprising a pair of jaws carrying a mating pair of crimping dies, means for moving the jaws between an open position wherein the dies are spaced apart, and a closed position wherein the dies are relatively closer together and a pair of stop surfaces on respective ones of the jaws are in abutting relationship, and means for verifying that the stop surfaces are in the abutting relationship. The means for verifying may be a means on one of the stop surfaces for sensing a normal force on the one stop surface. The means for sensing may include a piezoresistive sensor which changes resistance in response to application of the normal force thereon, or a piezoelectric sensor which generates a voltage in response to the normal force. The sensing means may be connected in a circuit which which generates an electrical signal upon the normal force reaching a threshold value, and a visual or audible signal may be generated to indicate that the normal force has reached the desired threshold.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
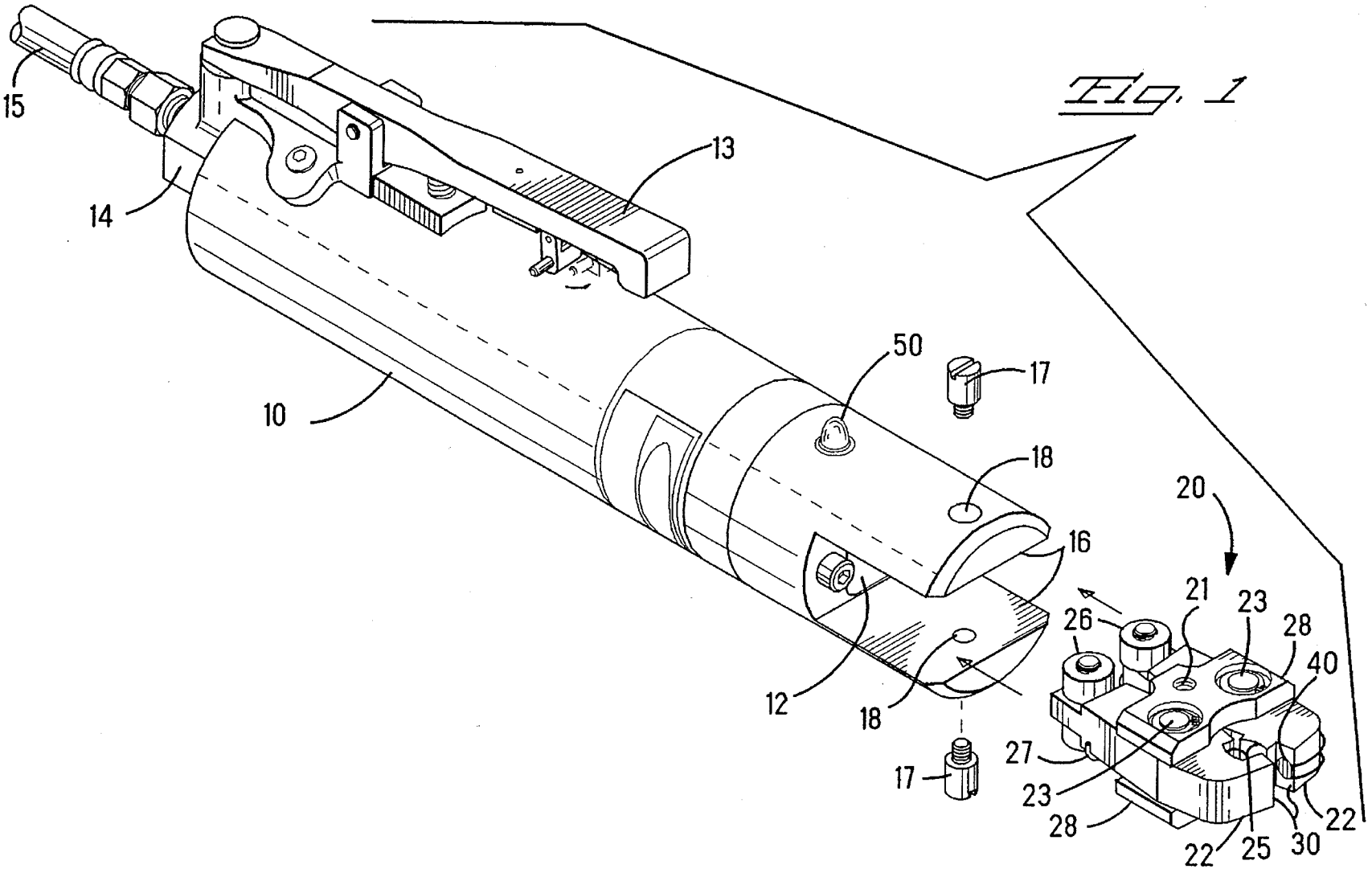
FIG. 1 is an isometric view of a crimping tool which is constructed according to the invention, showing a crimping head exploded away.
Figure 2:
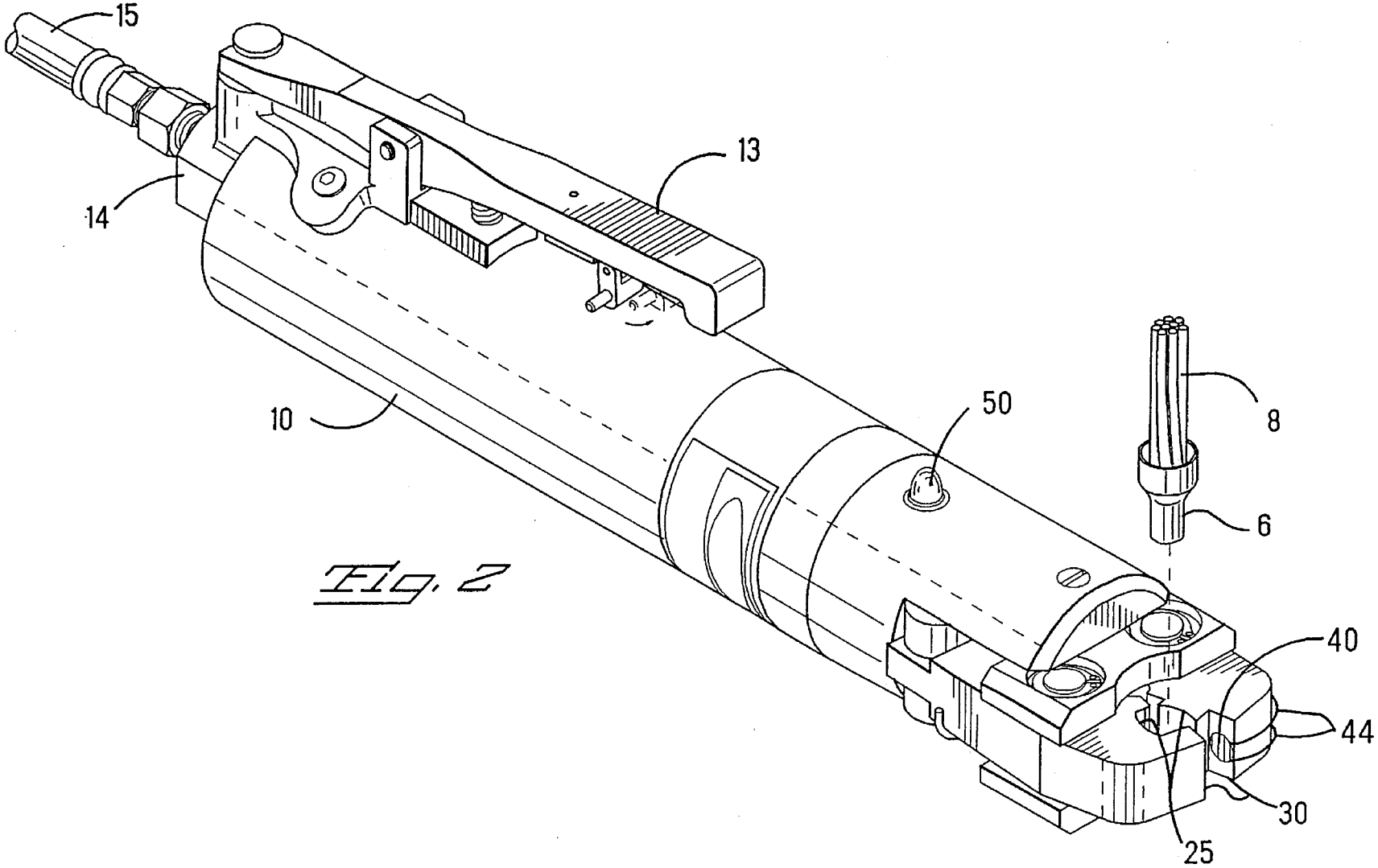
FIG. 2 is an isometric view of the assembled crimping tool.

There is shown in FIGS. 1 and 2 an exemplary crimping tool according to the invention. The tool includes a tool body 10 which houses an extensible cylinder actuable to drive a cam (not shown) axially outwardly from end 12. A lever 13 connected to a control valve 14 is operable to admit pneumatic forces received from a pressure source (not shown) through hose 15 so as to drive the cam outwardly from the end 12.

A crimping head assembly 20 is coupled between flanges 16 of the tool body 10 by retaining pins 17 which are slip fit in holes 18 and threadedly engaged in holes 21. The crimping head assembly 20 includes a pair of jaws 22 carrying a mating pair of crimping dies 25 which are cooperable to crimp a closed-end splice or other terminal 6 to a conductor 8. The dies 25 may be integrally formed in the jaws 22, or the dies may be separate components which are replaceable to remedy wear or breakage. The jaws 22 are pivotable on respective pivot pins 23 which are supported in retainer plates 28. Rollers 26 at rearward ends of the jaws 22 are urged apart by the cam (not shown) upon actuation of the cylinder in the tool body 10, thereby pivoting the jaws 22 from an open to a closed position and driving the dies 25 together to crimp a product. The crimping head 20 includes a spring 27, one end of which is shown, for urging the jaws to pivot oppositely from the closed to the open position so as to move the dies relatively apart upon retraction of the cylinder and cam. The actuation cylinder, cam and spring comprise a means for moving the jaws between the open and closed positions.

Figure 3:
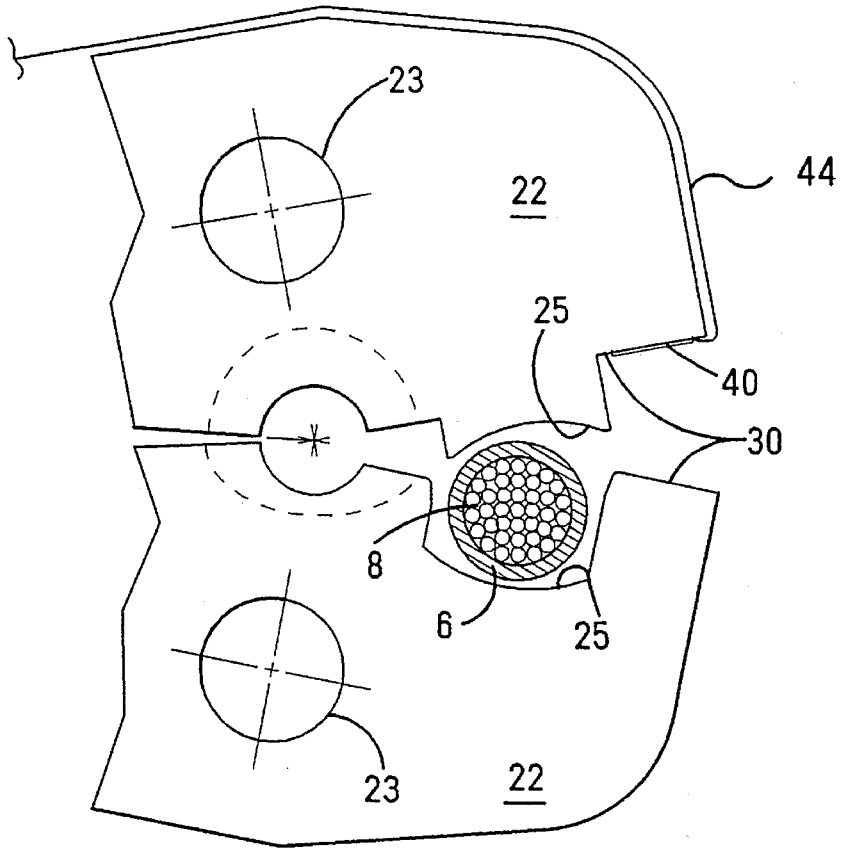
FIG. 3 is an enlarged cross-sectional view of the jaws of the crimping tool in an open position.
Figure 4:
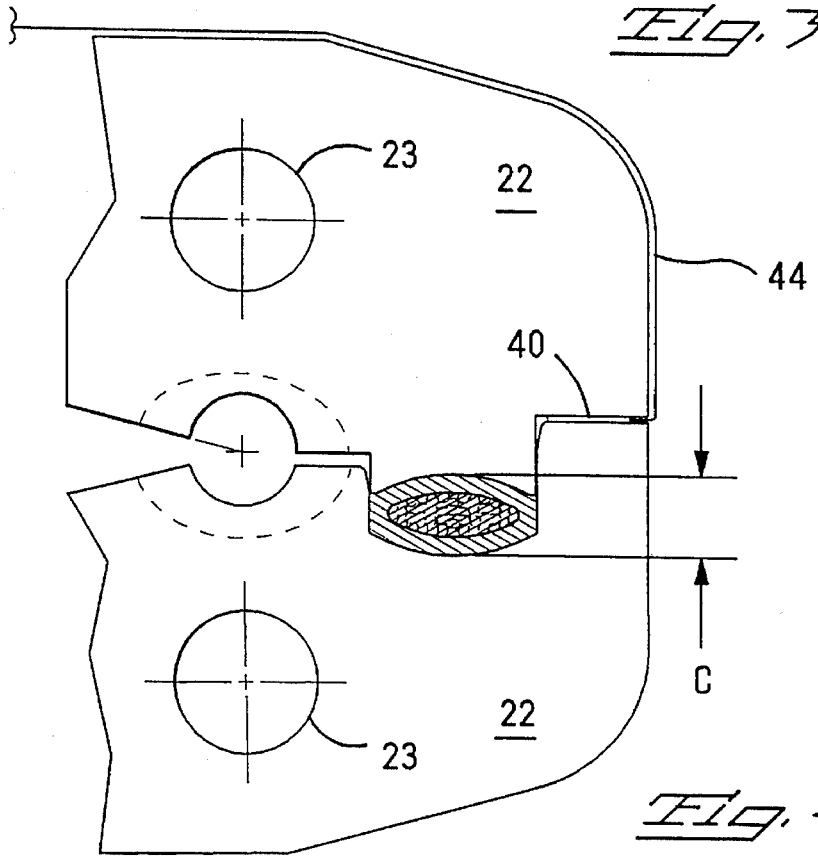
FIG. 4 is an enlarged cross-sectional view of the jaws of the crimping tool in a closed position, and a terminal crimped therebetween.

Referring to FIGS. 3 and 4, the jaws 22 have respective stop surfaces 30 which come into abutment when the jaws are pivoted to the closed position. Abutment of the stop surfaces 30 defines a fully closed position of the jaws 22, and the dies 25 are arranged so that a terminal 6 engaged between the dies is fully crimped when the jaws are in the fully closed position. More particularly, the dies 25 are arranged with respect to the stop surfaces 30 such that the dies are spaced apart by a specific amount when the stop surfaces 30 come into abutment. The spacing between the dies is selected such that when the jaws are fully closed, a terminal engaged between the dies will be deformed by an amount which is necessary to produce a desired crimp height C for the terminal after the terminal is released from between the dies, taking into account some relaxation of the deformed terminal due to elasticity of the material.

Figure 5:
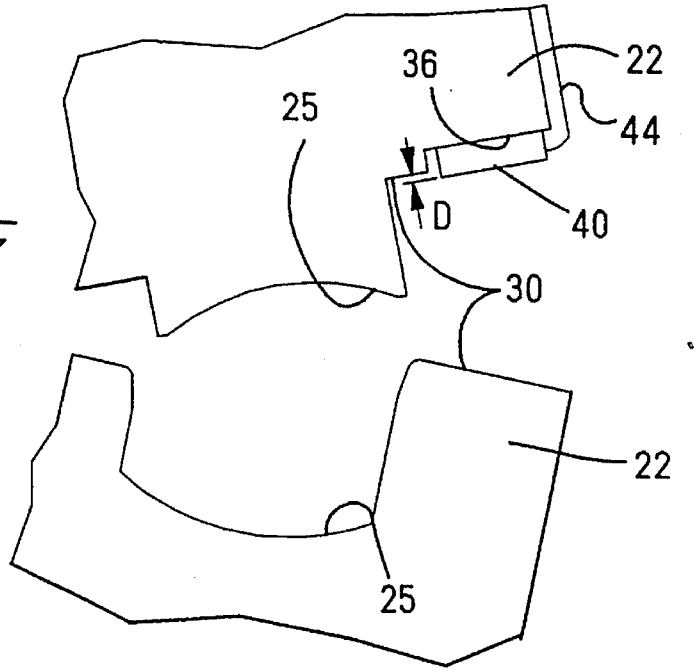
FIG. 5 is an enlarged cross-sectional view of the jaws with a force sensor disposed thereon.

The tool further includes a means for verifying that the stop surfaces 30 are in abutting relationship. The means for verifying comprises means for sensing a normal force on one of the stop surfaces, and means for generating an electrical signal upon application of the normal force on the one stop surface. In one embodiment the means for sensing includes a flat film sensor 40 which is mounted on one of the stop surfaces 30. The flat film sensor 40 may be a piezoresistive sensor which is a force sensing resistor that changes its electrical resistance in response to application of the normal force thereon. The piezoresistive sensor is made from a wafer of piezoresistive material which is formed with conductive traces and enclosed in a tough plastic substrate. Such a piezoresistive sensor is sold by Interlink Electronics of Carpinteria, Calif. under model no. 300B. The piezoresistive sensor is on the order of 0.010 inch thick and can be mounted directly on the face of one of the stop surfaces 30 with a suitable adhesive or with a tape overlay. Alternatively, a step 36 of appropriate depth may be formed in one of the stop surfaces as shown in FIG. 5, and the sensor 40 may be mounted on the step 36 so that the sensor 40 protrudes above the stop surface 30 by an interference dimension D which is on the order of 0.001 inch.

The piezoresistive sensor is connected in an electrical circuit by wires or conductive traces 44 which are enclosed within an extension of the same plastic substrate that encloses the sensor. The electrical circuit includes a power source, preferably low voltage DC, which may be supplied by a battery mounted on the tool body. An example of a suitable circuit is described in a publication titled "Tech-Notes New Release" dated September 1990 which is published by Interlink Electronics of Carpinteria, Calif., which publication is incorporated by reference as if set forth fully herein. Briefly, a fixed voltage input to the sensor varies in output as the sensor resistance changes with application of the normal force thereon. The circuit includes a voltage comparator which is toggled by a specific triggering voltage. When the normal force on the sensor 40 reaches a level whereby the sensor output voltage equals the triggering voltage, the comparator is toggled and an electrical output signal is generated. The triggering voltage may be selectively adjustable such as by changing a reference voltage for the comparator, whereby a threshold of the normal force which must be applied to the sensor in order to generate the electrical output signal may be varied.

The tool may also include means responsive to the electrical signal for indicating presence of the normal force on the one stop surface. For example, the electrical output signal may be used to trigger a visual or audio display such as an indicator light 50 or a buzzer. The visual or audio display alerts a tool operator that the jaws have fully closed and, presumably, that a terminal being crimped will have the correct crimp height.

Alternatively, the tool may include means responsive to the electrical signal for triggering the means for moving. In an automatic crimping tool, after the jaws have fully closed, the electrical output signal may be used to trigger a control valve which redirects actuators to move the jaws from the closed to the open position.

In another embodiment, the flat film sensor 40 is a piezoelectric sensor which itself produces a voltage in response to deflection caused by a force thereon. Although the piezoelectric sensor generates its own current, the current is relatively small and is preferably increased by an amplifier in order to attain a power level sufficient to activate a display or a control relay.

Figure 6:
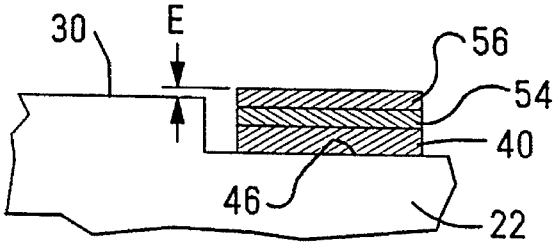
FIG. 6 is an enlarged cross-sectional view of the jaws with a force sensor disposed thereon in an alternative arrangement.

An alternative arrangement of the sensor 40 on one of the stop surfaces is shown in FIG. 6. The sensor 40 is disposed in a relief 46 which is sufficiently deep so that the sensor 40 resides below the stop surface 30. A shim 54 which may be made from metal or hard plastic is disposed above the sensor 40, and a tape overlay 56 retains the sensor and the shim to the jaw. In this embodiment a shim of appropriate thickness could be selected to provide a desired interference dimension E, which is a height above the stop surface 30, within a close tolerance, without having to closely control a tolerance on the depth of the relief. Further, the shim would protect the sensor from dirt or debris that might puncture the protective substrate and short the grid of the sensor. The tape overlay 56 could be omitted by using an adhesive applied to the top and bottom of the sensor 40, or by using a mechanical locking clip that entraps the sensor 40 and the shim 54. In those cases the shim 54 would protrude above the stop surface 30 by the interference dimension E.

Figure 7:
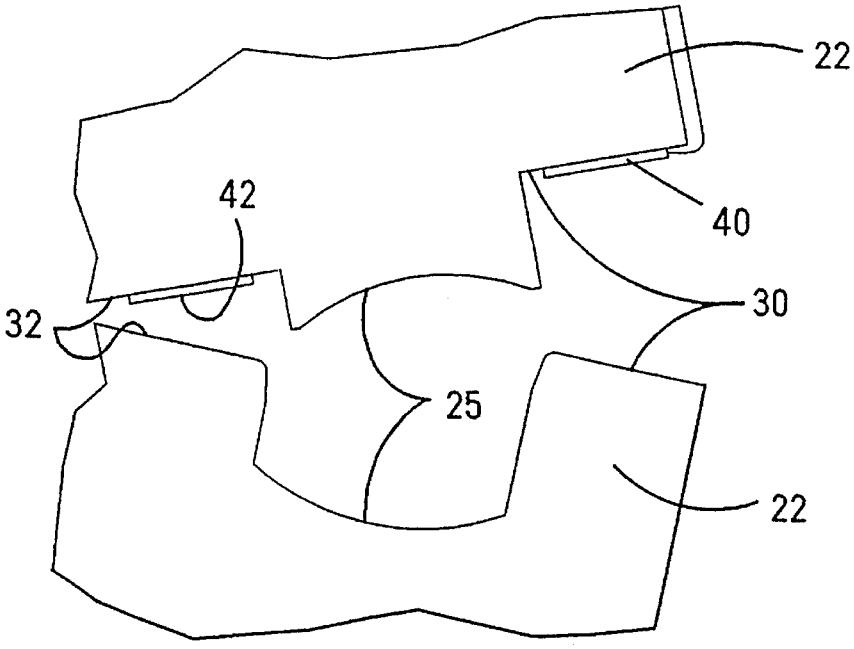
FIG. 7 is an enlarged cross-sectional view of tool jaws having dual force sensors.

A problem may arise in that a piece of debris between the stop surfaces 30 may inadvertently engage the flat film sensor 40 and trigger an indication that the jaws are fully closed. This problem may be overcome by a second set of stop surfaces 32 having a second sensor 42 as shown in FIG. 7. In this case the means for generating an electrical signal would be arranged so that an input from both of the sensors 40 and 42 would be required before the electrical signal would be generated. Thus, a piece of debris which engages one of the sensors would not generate a false indication of die closure.

A crimping tool according to the invention has the advantage that full closure of the crimping dies is verified, thereby increasing the effectiveness of the tool and reducing the possibility that a terminal will not be fully crimped.

The invention having been disclosed, a number of variations will now become apparent to those skilled in the art. Although the invention has been illustrated in one embodiment comprising a hand tool, it should be understood that the invention is readily adapted for use in a broad range of crimping apparatus including bench mounted applicators.

Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A crimping apparatus comprising:

a pair of jaws carrying a mating pair of crimping dies;

means for moving the jaws between an open position wherein the dies are spaced apart, and a closed position wherein the dies are relatively closer together and a pair of stop surfaces on respective ones of the jaws are in abutting relationship, thereby applying a force on one of the stop surfaces; and, means for verifying that the stop surfaces are in the abutting relationship, including means for generating an electrical signal upon application of the force on the one stop surface.

2. The apparatus according to claim 1, further comprising means responsive to the electrical signal for indicating presence of the force on the one stop surface.

3. The apparatus according to claim 2, wherein the means for indicating comprises a visual display.

4. The apparatus according to claim 2, wherein the means for indicating comprises an audio display.

5. The apparatus according to claim 1, further comprising means responsive to the electrical signal for triggering the means for moving.

6. The apparatus according to claim 1, wherein the means for generating an electrical signal includes a piezoresistive sensor disposed on the one stop surface.

7. The apparatus according to claim 1, wherein the means for generating an electrical signal includes a piezoelectric sensor disposed on the one stop surface.

8. The apparatus according to claim 1, further comprising a second pair of stop surfaces on respective ones of the jaws, and means for generating an electrical signal upon application of a force on one of the stop surfaces of the second pair.

9. The apparatus according to claim 1, wherein the means for generating is adjustable to change a threshold of the force which must be applied to the one stop surface to generate the electrical signal.

10. A crimping apparatus comprising:

a pair of jaws having respective stop surfaces, the jaws being relatively movable between an open position wherein the stop surfaces are spaced apart, and a closed position wherein the stop surfaces are in abutting relationship, thereby applying a force on one of the stop surfaces, the jaws carrying respective crimping dies;

means for moving the jaws between the open and closed positions; and, means for sensing the force on the one stop surface, including means for generating an electrical signal upon application of the force.

11. The apparatus according to claim 10, wherein the means for sensing includes a piezoresistive sensor disposed on the one stop surface.

12. The apparatus according to claim 10, wherein the means for sensing includes a piezoelectric sensor disposed on the one stop surface.

13. The apparatus according to claim 10, further comprising means responsive to the electrical signal for indicating presence of the force on the one stop surface.

14. The apparatus according to claim 13, wherein the means for indicating comprises a visual display.

15. The apparatus according to claim 13, wherein the means for indicating comprises an audio display.

16. The apparatus according to claim 10, further comprising means responsive to the electrical signal for triggering the means for moving.

17. The apparatus according to claim 10, wherein the means for generating is adjustable to change a threshold of the force which must be applied to the one stop surface to generate the electrical signal.

* * * * *